United States Patent [19]

Tomaru

[11] 4,417,929

[45] Nov. 29, 1983

[54] SPECIAL BRASS WITH DEZINCIFICATION CORROSION RESISTANCE

[75] Inventor: Hisao Tomaru, Yamanashi, Japan

[73] Assignee: Kitz Corporation, Tokyo, Japan

[21] Appl. No.: 300,287

[22] Filed: Sep. 8, 1981

[30] Foreign Application Priority Data

Sep. 11, 1980 [JP] Japan ..... 55-125342

[51] Int. Cl.[3] ..... C22C 9/04; C22F 1/08

[52] U.S. Cl. ..... 148/433; 148/11.5 C; 420/471; 420/473; 420/475

[58] Field of Search ..... 75/157.5; 420/475, 473, 420/477, 478; 148/11.5 C, 433

[56] References Cited

U.S. PATENT DOCUMENTS

| | | | |
|---|---|---|---|
| Re. 19,915 | 4/1936 | Freeman, Jr. | 420/475 |
| 2,061,921 | 11/1936 | Roath | 75/157.5 |
| 3,963,526 | 6/1976 | Lunn | 75/157.5 |

FOREIGN PATENT DOCUMENTS

| | | | |
|---|---|---|---|
| 53-56126 | 5/1978 | Japan | 420/473 |

*Primary Examiner*—Peter K. Skiff

*Attorney, Agent, or Firm*—Wenderoth, Lind & Ponack

[57] ABSTRACT

Special brass with dezincification corrosion resistance, which is essentially composed of copper, zinc, antimony, lead and tin, thereby to remarkably improve the corrosion resistance and the mechanical properties. With at least one addition of iron, aluminium and silicon, the corrosion resistance and mechanical properties are still more improved.

4 Claims, 3 Drawing Figures

(× 100)

(× 100)

(x 100)

SPECIAL BRASS WITH DEZINCIFICATION CORROSION RESISTANCE

BACKGROUND OF THE INVENTION

This invention relates to special brass with dezincification corrosion resistance, and more particularly, to special brass composed of copper and zinc as the main components, along with additions of antimony, lead and tin, plus a trace of impurities. This brass has excellent dexincification corrosion resistance and mechanical properties.

Generally, brass possesses excellent mechanical properties, resistance to dezincification corrosion and a beautiful gloss and is extensively used because it is inexpensive compared with the other copper alloys. However, it readily suffers from dezincification corrosion thereby causing a serious disadvantage. The problems which stand in the way of practical use of, for example, brassy parts for valves will be explained hereinafter.

The brassy parts for valves are chiefly composed of so-called 6–4 brass, namely, containing 60% of copper and 40% of zinc. Particularly, among the brassy parts for valves, a part to be used as a valve stem (which is manufactured from a free cutting brass bar or forging brass bar) is apt to be broken owing to dezincification corrosion thereby causing malfunction of the valve. The dezincification corrosion in brass tends to occur remarkably in sea water, polluted water and hot water. Especially, when copper pipe is used as a supplying pipeline in a high-rise building, through which hot water at temperatures of about 60° C. to 80° C. is supplied, there have been some cases in which the stem of a valve used in the pipelines suffers from dezincification corrosion within one to three years, thereby to prevent the valve from being used continuously.

In recent years, many copper alloy materials resistant to dezincification corrosion have been developed, but such corrosion resistance is not yet satisfactory. Although the addition of a poisonous substance has been considered for improving dezincification corrosion resistance of brass, it is unpractical. Thus, there is no alloy with dezincification corrosion resistance, which is satisfictory for practical use.

SUMMARY OF THE INVENTION

A primary object of the present invention is to provide special brass of extremely improved resistance to dezincification corrosion.

Another object of the present invention is to provide special brass excellent in tensile strength, ductility, hardness and wear resistance.

To attain the objects described above according to the present invention, there is provided special brass being essentially composed of mainly copper and zinc, with additions of antimony, lead and tin.

The special brass composed of the aforementioned components excels in dezincification corrosion resistance and mechanical properties such as tensile strength, ductility, hardness and wear resistance. The aforementioned excellent properties of the special brass can be still more improved by adding thereto at least one substance selected from the group consisting of iron, aluminum and silicon.

The above and other related objects and features of the invention will be apparent from the following description of the invention in connection with the accompanying drawings.

DESCRIPTION OF THE PREFERRED EMBODIMENTS

Figure 3:
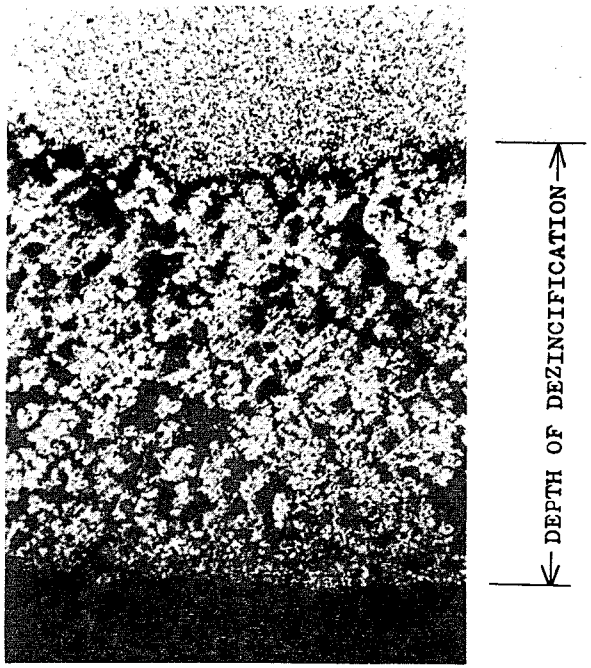
FIG. 3 is a microscopic photograph at a $1\times10^2$ magnification, showing the result of the same corrosion experiment on the conventional antidezincification brass bar (Comparative specimen #3).

This invention relates to special brass essentially composed of copper and zinc, along with additions of antimony, lead and tin, and more particularly, is characterized by the fact that it produces special brass with excellent dezincification corrosion resistance by use of the addition of antimony, especially.

The modes of actions and effects exerted by the components of the special brass according to the present invention and the reasons for the ranges of the amounts of these components will be explained hereinafter.

COPPER (Cu): 58.0% to 63.0% by weight

Inasmuch as dezincification corrosion is initiated in the beta phase in brass alloy in the microscopic structure, the conventional alloys with dezincification corrosion resistance were generally constituted in the form of alpha phase, and thus, the copper content has hitherto been selected at 63% or more. On the contrary, brass according to the present invention is made up of alpha + beta phase, and occur, dezincification corrosion scarcely occurs in not only the alpha phase, but also in the beta phase, under the influence of antimony and other additions as described hereinafter. Therefore, the copper content in the present invention is limited to 58.0% to 63.0% by weight, preferably 60% to 62% by weight, in due consideration of the mechanical properties, wear resistance and economical advantage.

ANTIMONY (Sb): 0.02% to 0.5% by weight

Dezincification corrosion is classified into (i) selective elution corrosion and (ii) reprecipitation corrosion. In the case of (i), zinc is eluted from the alloy as $Zn^{2+}$, but copper is not eluted. In the case of (ii), zinc and copper are both eluted in the form of ions from the alloy. Copper thus eluted is however immediately educed on the alloy to be turned into metallic copper. This is because the dezincification corrosion reaction of the alloy is accelerated with the aid of electric voltage which is so generated that the dissolution of Zn causes generation of electrons and the educed Cu acts as the cathode in the brass in accordance with the following chemical formulas:

$$\text{Zn (in brass)} \rightarrow Zn^{2+}\text{(in water)} + e^{-}\text{(in brass)}$$

$$Cu^{+}\text{ (in water)} + e^{-} \rightarrow \text{Cu (metal)}$$

Antimony used as a trace addition to brass shows its ability to hinder the reprecipitation of copper ion. Namely, the hindrance of the reprecipitation of copper ion is accomplished by varying the electric potential in the alpha phase of brass by the medium of an absorption or compound film being formed on the brass. Though the addition of antimony contributes to the resistance to dezincification corrosion, the addition of more than 0.5% by weight of antimony results in a lowering of the properties of tensile strength and impact strength and involves a reduced effect of corrosion resistance. Accordingly, the antimony content is limited to 0.02% to 0.5% by weight, preferably, 0.05% to 0.1% by weight.

LEAD (Pb): 0.5% to 3.0% by weight

Lead is added to brass in order to improve its cutting property. Brass having less than 0.5% of lead is insufficient in the cutting property, and on the other hand, with the addition of too much lead, the tensile strength, ductility and impact strength decrease. Accordingly, the lead content is limited to 0.5% to 3.0% by weight.

TIN (Sn): 0.2% to 1.0% by weight

As is known to the art, the function of tin is to prevent dezincification corrosion and stress corrosion (season crack) of brass. However, when adding tin in an amount of more than the solid solution limit, the brass becomes more brittle and readily develops forging cracks by the occurrence of $Cu_4Sn$ phase. For this reason, the tin content in the present invention is limited to not more than 1% by weight.

IRON (Fe): 0.1% to 0.5% by weight

Iron functions as an agent to minutely fractionate the crystals of brass. When brass contains iron rather in excess, the corrosion resistance and the mechanical properties such as ductility and impact strength are both reduced due to the phase structure being rich in iron content. Accordingly, the iron content is limited to 0.1% to 0.5% by weight ALUMINIUM (Al): 0.03% to 0.2% by weight With the addition of aluminium, the mechanical properties such as tensile strength, resistibility and hardness of brass are improved, thereby resulting in remarkably excellent properties of wear resistance, cavitation-erosion resistance and corrosion resistance. With too much aluminium, the properties of ductility and impact strength are reduced. Accordingly, the aluminium content in the present invention is limited to not more than 0.2% by weight.

SILICON (Si): 0.03% to 0.2% by weight

With the addition of silicon, brass has the improved properties of tensile strength, resistibility and hardness, thereby remarkably improving the properties of wear resistance, cavitation-erosion resistance and corrosion resistance. With the addition of too much silicon, the properties of ductility and impact strength are reduced. Accordingly, the silicon content in this invention is limited to not more than 0.2% by weight.

The brass thus constituted is inevitably contaminated by small amounts of impurities such as iron, aluminium, manganese, phosphorus, silicon and sulfur.

The special brass described in detail according to the present invention is further characterized in that the dezincification corrosion resistance is still more improved by elongation working. This feature is extremely available because the conventional alloys of this sort have frequently been used as an elongating material. A method of elongation working for processing special brass to attain the aforementioned effects comprises the steps of subjecting brass material to a cold drawing process after carrying out hot extrusion at about 700° C. and subjecting it to surface treatment and stress-relieving treatment, whereby the crystal structure thereof is minutely fractionated to improve the mechanical properties and antidezincification corrosion.

EXAMPLE

Several experiments involving the brass (Specimens I to XII) of the present invention were carried out in various ways to prove the excellent properties thereof. The components of those specimens used in the experiments are shown in Table 1A.

The components of the conventional special brass (Comparative specimens #1 to #4) on which experiments were performed in the same manner, are shown in Table 1B.

TABLE 1A

| Specimen | Chemical components (% by weight) | | | | | |
|---|---|---|---|---|---|---|
| | Cu | Sn | Zn | Pb | Fe | Sb |
| I | 58.8 | 0.20 | rest | 2.01 | 0.13 | 0.032 |
| II | 59.2 | 0.21 | rest | 1.99 | 0.12 | 0.042 |
| III | 58.7 | 0.17 | rest | 1.86 | 0.11 | 0.055 |
| IV | 60.6 | 0.20 | rest | 2.07 | 0.13 | 0.030 |
| V | 59.0 | 0.17 | rest | 1.91 | 0.11 | 0.038 |
| VI | 60.0 | 0.33 | rest | 1.84 | 0.15 | 0.052 |
| VII | 62.1 | 0.54 | rest | 0.74 | 0.10 | 0.031 |
| VIII | 61.8 | 0.34 | rest | 0.83 | 0.10 | 0.038 |
| IX | 62.3 | 0.55 | rest | 0.89 | 0.12 | 0.046 |
| X | 63.4 | 0.55 | rest | 0.96 | 0.09 | 0.033 |
| XI | 62.9 | 0.52 | rest | 0.74 | 0.04 | 0.047 |
| XII | 63.1 | 0.49 | rest | 0.75 | 0.75 | 0.058 |

TABLE 1B

| Comparative specimen | Chemical components (% by weight) | | | | | | Remarks |
|---|---|---|---|---|---|---|---|
| | Cu | Sn | Zn | Pb | Fe | As | |
| #1 | 57.6 | 0.25 | rest | 2.93 | 0.17 | — | Forging brass bar |
| #2 | 58.7 | 0.24 | rest | 3.06 | 0.17 | — | |
| #3 | 63.6 | 1.20 | rest | 1.75 | 0.39 | — | Brass with antidezincification |
| #4 | 63.5 | 0.10 | rest | 1.68 | 0.04 | 0.03 | |

The conventional forging brass bars, which do not contain antimony, were adopted as the comparative specimens #1 and #2 according to JIS (Japanese Industrial Standard). The comparative specimens #3 and #4 were the conventional brass bars with antidezincification corrosion which are composed of alpha phase and contain a high percentage of copper. Further, the comparative specimen #3 contains a high percentage of tin. The comparative specimen #4 contains arsenic.

The results of experiments on the aforementioned specimens will be presented hereinafter.

The experiments for mechanical properties such as tensile strength, ductility and hardness produced the results shown in Table 2A and Table 2B.

TABLE 2A

| Specimen | Diameter of specimen ($mm^{\phi}$) | Mechanical property | | Hardness (HRB) |
|---|---|---|---|---|
| | | Tensile strength ($kg/mm^2$) | Elongation (%) | |
| I | 14 | 47.6 | 21.1 | 78.8 |
| II | 14 | 47.6 | 21.6 | 77.8 |
| III | 14 | 49.3 | 18.0 | 79.0 |
| IV | 14 | 44.8 | 20.8 | 78.0 |
| V | 14 | 45.4 | 22.2 | 75.7 |
| VI | 14 | 41.8 | 23.0 | 72.6 |
| VII | 14 | 40.9 | 39.2 | 65.0 |
| VIII | 14 | 43.2 | 31.5 | 65.0 |
| IX | 14 | 41.5 | 32.5 | 67.0 |
| X | 14 | 35.7 | 37.7 | 61.0 |
| XI | 14 | 38.0 | 36.2 | 64.0 |

TABLE 2A-continued

| Specimen | Diameter of specimen (mm$^{\phi}$) | Mechanical property: Tensile strength (kg/mm$^2$) | Elongation (%) | Hardness (HRB) |
|---|---|---|---|---|
| XII | 14 | 37.0 | 36.0 | 55.0 |

TABLE 2B

| Specimen | Diameter of specimen (mm$^{\phi}$) | Mechanical property: Tensile strength (kg/mm$^2$) | Elongation (%) | Hardness (HRB) |
|---|---|---|---|---|
| #1 | 14 | 51.1 | 18.1 | 80 |
| #2 | 14 | 49.0 | 18.3 | 81.8 |
| #3 | 14 | 43.0 | 30.0 | 72 |
| #4 | 14 | 38.0 | 36.0 | 55 |

It is evident from the results shown in Table 2A that the addition of antimony has no effect on the mechanical properties of the special brass according to the present invention. The results of the experiments for antidezincification corrosion are shown in Table 3A and Table 3B. The experiments were carried out by using test pieces (10 mm$^{\phi}$×15 mm), immersing the pieces in 1% cupric chloride solution, heating them at 75° C. ±3° C. for 24 hours in the solution, and thereafter, measuring the loss in weight and the depth of the dezincification layer.

TABLE 3A

| Specimen | Loss in weight (mg/cm$^2$/hr) | Depth of dezincification (mm/hr × $10^{-2}$) |
|---|---|---|
| I | 9.33 | 3.39 |
| II | 9.23 | 2.95 |
| III | 8.18 | 2.74 |
| IV | 5.84 | 2.64 |
| V | 4.58 | 2.12 |
| VI | 2.25 | 0.19 |
| VII | 4.09 | 0.9 |
| VIII | 3.87 | 0.6 |
| IX | 4.31 | 0.3 |
| X | 4.40 | 0 |
| XI | 3.98 | 0 |
| XII | 4.13 | 0 |

TABLE 3B

| Specimen | Loss in weight (mg/cm$^2$/hr) | Depth of dezincification (mm/hr × $10^{-2}$) |
|---|---|---|
| #1 | 18.04 | 7.30 |
| #2 | 8.62 | 5.32 |
| #3 | 6.77 | 1.50 |

TABLE 3B-continued

| Specimen | Loss in weight (mg/cm$^2$/hr) | Depth of dezincification (mm/hr × $10^{-2}$) |
|---|---|---|
| #4 | 6.36 | 0 |

As is apparent from the aforementioned results of the experiments, the special brass specimens according to the present invention are remarkably reduced in corrosion loss and depth of dezincification layer compared to the comparative specimens. The dezincification layer becomes shallow with increased antimony content, thereby entailing excellent antidezincification effect.

Figure 1:
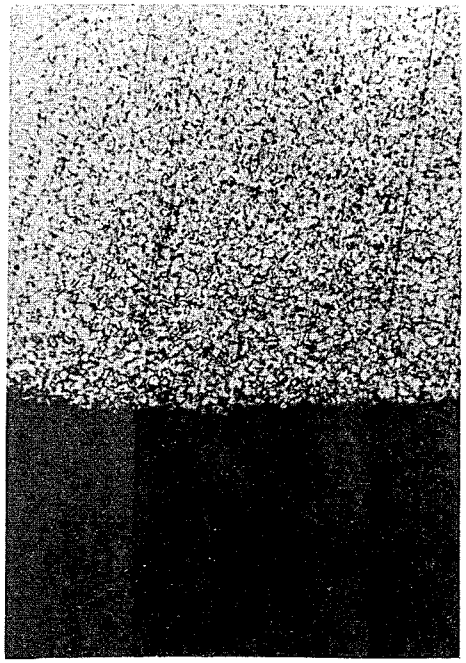
FIG. 1 is a microscopic photograph at a $1\times10^2$ magnification, showing the result of at dezincification corrosion experiment on a special brass (Specimen VI) according to the present invention.
Figure 2:
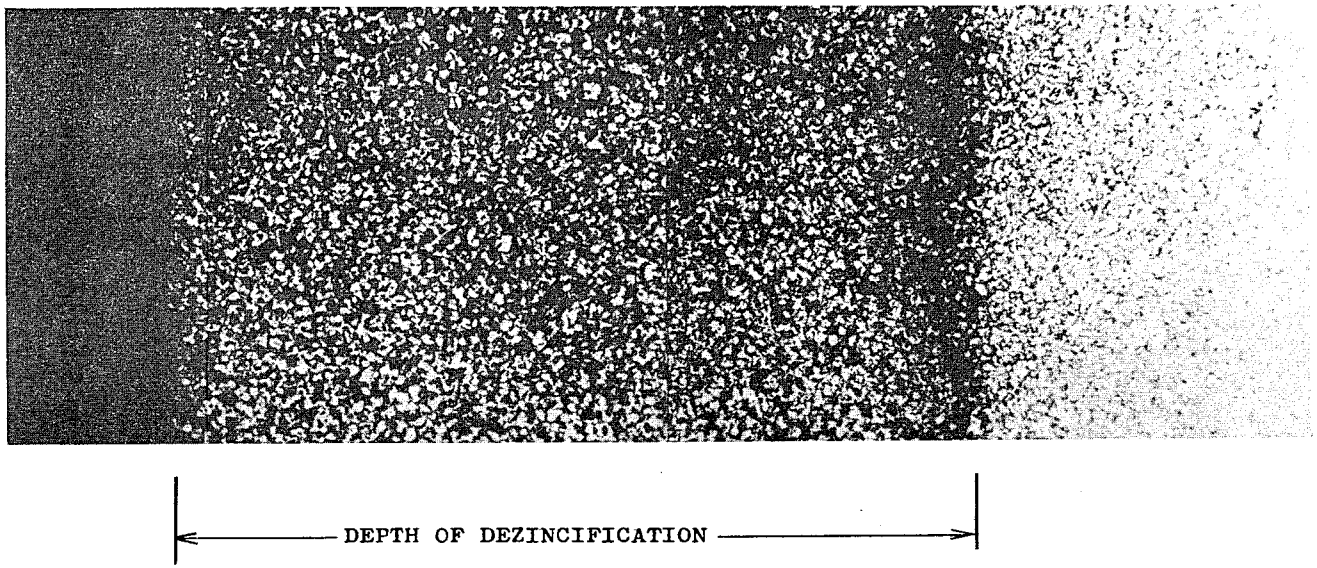
FIG. 2 is a microscopic photograph at a $1\times10^2$ magnification, showing the result of a corrosion experiment on the conventional forging brass bar (Comparative specimen #2).

Though the comparative specimen #4 excels in a reduced depth of dezincification layer, the use thereof is restricted due to harmful elements included therein as described previously. The microscopic photographs of the specimen VI according to the present invention and the comparative specimen #2 and #3 used in the experiments are respectively shown in FIGS. 1, 2 and 3. As especially shown in FIG. 2, the comparative specimen #2 has a thicker dezincification layer. On the contrary, such dezincification is scarcely observed in the specimen according to the present invention as shown in FIG. 1.

As is readily understood from the above, the special brass containing antimony according to the present invention excels in antidezincification corrosion and acquires desirable mechanical properties and sufficient wear resistance and, specifically, is suitably used as alloys for valves.

What is claimed is:

1. Brass having dezincification corrosion resistance, obtained by a process which comprises:

providing a mixture which consists of 58.0% to 62.0% by weight of copper, 0.02% to 0.5% by weight of antimony, 0.5% to 3.0% by weight of lead, 0.2% to 1.0% by weight of tin, 0.1% to 0.5% by weight of iron, and, optionally, at least one member selected from the group consisting of 0.03% to 0.2% by weight of aluminium and 0.03% to 0.2% by weight of silicon, the rest being zinc and unavoidable impurities, extruding said mixture at a temperature of about 700° C., cold drawing the extruded product, and subjecting the cold drawn product to a stress-relieving treatment to obtain a brass having a fractionated crystal structure and a tensile strength of at least 41.8 kg/mm$^2$.

2. The brass according to claim 1, which contains 0.03% to 0.2% by weight of aluminium.

3. The brass according to claim 1, which contains 0.03% to 0.2% by weight of silicon.

4. The brass according to claim 2, which contains 0.03% to 0.2% by weight of silicon.

* * * * *